United States Patent [19]

Bloecher et al.

[11] Patent Number: 4,799,939

[45] Date of Patent: Jan. 24, 1989

[54] ERODABLE AGGLOMERATES AND ABRASIVE PRODUCTS CONTAINING THE SAME

[75] Inventors: Ulrich Bloecher, St. Paul, Minn.; Ernest J. Duwell, Hudson, Wis.

[73] Assignee: Minnesota Mining and Manufacturing Company, St. Paul, Minn.

[21] Appl. No.: 27,784

[22] Filed: Mar. 19, 1987

Related U.S. Application Data

[63] Continuation-in-part of Ser. No. 420,690, Feb. 26, 1987, Pat. No. 4,528,522.

[51] Int. Cl.[4] ..... B24D 3/00

[52] U.S. Cl. ..... 51/293; 51/295; 51/296; 51/298; 51/308

[58] Field of Search ..... 51/293, 295, 298, 308, 51/296

[56] References Cited

U.S. PATENT DOCUMENTS

| | | | |
|---|---|---|---|
| Re. 29,808 | 10/1978 | Wagner | 51/296 |
| 2,806,772 | 9/1957 | Robie | 51/298 |
| 2,986,455 | 5/1961 | Sandmeyer | 51/296 |
| 3,874,856 | 4/1975 | Leeds | 51/296 |
| 4,311,489 | 1/1982 | Kressner | 51/298 |

FOREIGN PATENT DOCUMENTS 2417196 3/1976 Fed. Rep. of Germany .

*Primary Examiner*—Paul Lieberman
*Assistant Examiner*—Willie J. Thompson
*Attorney, Agent, or Firm*—Donald M. Sell; David L. Weinstein

[57] ABSTRACT

Erodable agglomerates containing individual abrasive grains disposed in an erodable matrix comprising hollow bodies and a binder. The agglomerates are useful for coated abrasives and bonded abrasives. Abrasive products containing the agglomerates provide higher stock removal than abrasive products bearing a single layer of abrasive grains, since the erodable character of the agglomerates allows the sloughing off of spent individual abrasive grains during abrading operations and the exposing of new abrasive grains to the workpiece. The invention also provides a method of preparing the agglomerates of this invention.

22 Claims, 2 Drawing Sheets

ERODABLE AGGLOMERATES AND ABRASIVE PRODUCTS CONTAINING THE SAME

This application is a continuation-in-part of Ser. No. 42,069 U.S.A. 1A, filed Feb. 26, 1987, now U.S. Pat. No. 4,528,522.

BACKGROUND OF THE INVENTION

This invention relates to erodable agglomerates containing abrasive grains, and, more particularly to abrasive products containing the erodable agglomerates.

Conventional coated abrasives typically consist of a single layer of abrasive grain adhered to a backing. It has been found that only up to about 15% of the grains in the layer are actually utilized in removing any of the workpiece. It follows then that about 85% of the grains in the layer are wasted. Furthermore, the backing, one of the more expensive components of the coated abrasive, must also be disposed of before the end of its useful life.

To overcome this problem of waste, many attempts have been made to distribute the abrasive grains on the backing in such a manner so that a higher percentage of abrasive grains can be utilized, thus leading to extended life of the coated abrasive product. The extended life further leads to fewer belt or disc changes by the operators, thereby saving time and reducing labor costs. It is apparent that merely depositing a thick layer of abrasive grains on the backing will not solve the problem, because the grains lying below the topmost grains are not likely to be used.

The prior art describes several attempts to distribute abrasive grains in a coated abrasive in such a way as to prolong the life of the product. U.S. Pat. No. Re. 29,808 describes a grinding material comprising a multiplicity of hollow bodies whose walls contain abrasive grains and a bonding means for bonding the abrasive grains to each other at the wall surface, whereby during grinding a multiplicity of fresh abrasive grains become continuously available at the grinding surface wherein the grinding action of the grinding surface depends exclusively on the size of the abrasive grains.

U.S. Pat. No. 2,806,772 discloses an abrasive article consisting essentially of abrasive granules, a phenolic resin bond therefor, and thin walled hollow spheres less than 0.025 inch in diameter distributed throughout the resin bond and between the abrasive granules. The spheres constitute 1 to 30% of the volume of the article.

U.S. Pat. No. 4,311,489 describes a coated abrasive product having abrasive particles secured to a backing by maker and size coats where each abrasive particle consists of an essentially solid agglomerate of fine abrasive grains and an inorganic, brittle cryolite matrix. The agglomerates have an irregular surface which permits a strong bond to the maker and size coats which permits gradual wearing down of the agglomerates during grinding by gradual removal of dulled abrasive grains from the agglomerates.

German Auslegeschrift No. 2,417,196 describes a coated abrasive article comprising an abrasive body on a substrate. The abrasive body comprises a hollow body, the walls of which are formed of binder and abrasive grain. The hollow bodies are ruptured during the grinding process, thus allowing the wall of the hollow body to act on the material being abraded. Accordingly, grain wear is distributed over the entire surface area of the substrate. Although the products described in those patents are useful, even greater utilization of abrasive grains in coated abrasives is desired by industry.

SUMMARY OF THE INVENTION

In one aspect, this invention involves erodable agglomerates comprising individual grains of abrasive mineral disposed in an erodable matrix, which matrix comprises a binder, preferably a resinous binder, and hollow bodies which facilitate breakdown of the agglomerates during their utilization in an abrasive product. The hollow bodies preferably comprise hollow microspherical particles formed from glass. The hollow bodies render the agglomerates sufficiently durable to avoid premature destruction under severe abrading conditions, yet sufficiently soft to break down under these abrading conditions.

The agglomerates of the present invention provide high stock removal because they provide extended life for the abrasive products in which they are utilized, since the spent individual abrasive grains and matrix are sloughed off during abrading operations and new abrasive grains are then exposed to the workpiece. Coated abrasive containing the agglomerates of this invention have been found to be useful for both finishing operations and stock removal operations. The key advantages of coated abrasives made with the agglomerates of this invention are long useful life, efficient use of abrasive grains, and ability to be used in wet environments, e.g. environments wherein water, oil, or combination thereof is employed.

In another aspect, this invention involves a method of making the aforementioned agglomerates and abrasive products containing same, e.g. coated abrasives and abrasive wheels. The hollow bodies prevent settling of the individual grains and assure retention of bulk and shape of the agglomerates during the curing step employed in making them.

DETAILED DESCRIPTION

Figure 1:
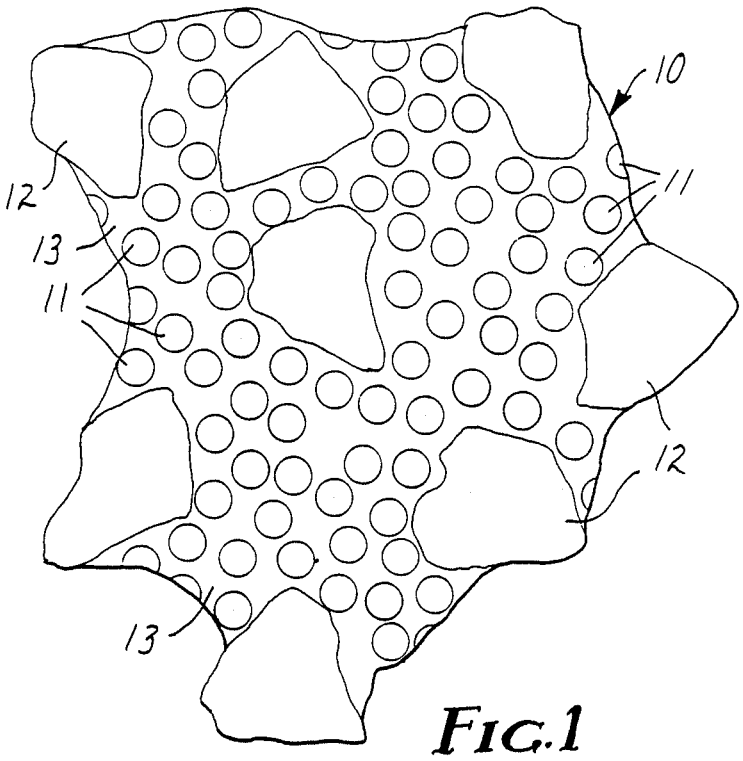
FIG. 1 is a schematic representation in cross-section of an agglomerate of this invention having a relatively medium percentage of binder.

Referring now to FIG. 1, an agglomerate 10 is shown which is erodable and has a multiplicity of voids therein. The essential ingredients of agglomerate 10 include hollow bodies 11, individual abrasive grains 12, and binder 13, with hollow bodies 11 and abrasive grains 12 being randomly distributed in binder 13. For the agglomerate to be erodable, both the hollow bodies and the binder must be erodable. The volume per unit weight of the agglomerate is higher than the volume per unit weight that would be expected from an agglomerate containing the same ingredients but having no voids therein. As used herein, the term "hollow" means having an empty space or cavity within a wall that is substantially impermeable to liquids; the term "hollow" is not intended to be synonymous with porous, as a porous body is permeable by liquids.

The key function of the hollow bodies is to facilitate breakdown of the agglomerates during use to reveal additional individual abrasive grains as the spent grains reach the end of their useful life. The hollow bodies may be of any shape, e.g. cylindrical, pyramidal, cubic, but are preferably spherical particles having a thin wall enclosing a void. As used herein, the term "spherical" means having a spherical or spheroidal shape. The spherical or spheroidal shape is preferred because it allows for better packing in the agglomerate. The hollow bodies must have very small diameters so that a large number of them can be incorporated into each agglomerate. In the case of spherical particles, the diameter of each particle can range from about five to about 150 micrometers, and the average diameter preferably ranges from about 30 to about 100 micrometers.

The microspherical particles are preferably hollow glass bubbles. The true bulk density of glass hollow bodies typically ranges from about 0.1 to about 0.6 g/cc. The value of true bulk density is determined by dividing the weight of the hollow bodies by the actual volume of the hollow bodies.

The hollow bodies must be crush resistant, i.e. they must have a crush strength sufficiently high to prevent collapse of the agglomerate during the process of preparation thereof and during storage of abrasive products made therefrom. The hollow bodies must also have a crush strength sufficiently low to be equal to or less than that of the binder in order to facilitate erosion of the agglomerate. It is preferred that the crush strength of the hollow bodies be no higher than about 15,000 psi and no lower than about 100 psi. Crush strength, as used herein, is measured in accordance with ASTM D3102-78.

It is highly desirable that the hollow bodies not undergo deleterious reaction with the resin or resins comprising the binder, in order that the binder not be weakened and the hollow bodies not be excessively softened or hardened. The physical structure of the hollow bodies is preferably of such a nature that when combined in the agglomerate with the binder, the hollow body/-binder composite contain sufficient void volume in order to facilitate breakdown of the agglomerate during abrading operations. Voids that appear in the agglomerate during abrading operations also allow both removal of ground debris and increased pressure of individual grains against the workpiece to asure breakdown of the agglomerates.

Hollow bodies that are suitable for this invention are sold under the trademark "3M" Glass Bubbles, and are commercially available from Minnesota Mining and Manufacturing Company. They are composed of a water insoluble, chemically stable glass. They are unicellular and average less than 70 micrometers in diameter.

Individual abrasive grains suitable for the present invention are well-known in the art and include, but are not limited to, aluminum oxide ($Al_2O_3$), zirconium oxide, garnet, emery, corundum, alumina:zirconia, carbides, such as silicon carbide, boron carbide, nitrides, such as cubic boron nitride, diamond, ruby, flint, modified ceramic aluminum oxide, and the like. Mixtures of grains can be used in individual agglomerates.

The disposition of the individual abrasive grains in the agglomerate may be "closed", i.e., with the individual grains making contact with one another, or "open", i.e., with spaces between the individual grains.

The functions of the binder are to bond the individual abrasive grains to the microspherical particles and to define the brittleness and breakdown character of the agglomerate. It is desirable that the matrix erode without softening, flowing, or melting.

Binders suitable for this invention are well-known in the art and include, but are not limited to, phenolic resins, urea-formaldehyde resins, phenol formaldehyde resins, epoxy resins, and alkyd resins. While synthetic organic binders are preferred, natural organic binders, e.g. hide glue, and inorganic binders can also be used.

Grinding aids can also be incorporated in the agglomerate. Representative examples of grinding aids suitable for the agglomerate of this invention include inorganic halides, e.g. cryolite ($Na_3AlF_6$), potassium borofluoride ($KBF_4$), inorganic sulfides, chlorinated hydrocarbons.

Conventional fillers can also be incorporated in the agglomerates. A representative example of such a filler is calcium carbonate.

The amount of each of the essential ingredients in the agglomerate can vary, but preferably ranges from about 0.3 to about 8 percent by weight microspherical particles, from about 95 to about 85 percent by weight abrasive mineral, and from about 5 to about 30 percent by weight binder. As the concentration of binder decreases, ease of breakdown of the agglomerate increases.

The agglomerates preferably range from 150 micrometers to 3000 micrometers in largest dimension. If the individual abrasive grains are very fine, for example corresponding to P180 (FEPA-Norm), then between 10 and 1000 individual grains will be contained in each agglomerate. If the individual abrasive grains correspond to P36, then between 2 and 20 grains will be contained in each agglomerate. The grade and type of the individual abrasive grains is not critical, and the grade typically ranges from P24 to P1000.

The agglomerates are typically irregular in shape, but they can be formed into spheres, spheroids, ellipsoids, pellets, rods, or other conventional shapes.

The erodability characteristics of the agglomerate, i.e. rate of breakdown or erosion under a given load, can be varied by varying the resinous binder and abrasive mineral with respect to identity of each, relative amount pf each, or both. For example, agglomerates having harder binders erode more slowly than agglomerates having softer binders; an agglomerate having a relatively high percentage of binder erodes more slowly than an agglomerate having a relatively low percentage of binder.

The agglomerates of the present invention can be prepared by the following procedure. Abrasive grains, resin, and hollow bodies are introduced into a mixing vessel, and the resulting mixture stirred until it is homogeneous. The preferred composition for preparing the agglomerates comprises 100 parts by weight hollow bodies, 900 parts by weight water, 1100 parts by weight resinous binder, and 6600 to 10,000 parts by weight abrasive mineral. It is preferred that there be sufficient liquid in the mixture that the resulting mixture not be excessively stiff or excessively runny. Most resins contain sufficient liquid to permit adequate mixing. After the mixing step is complete, the mixture is caused to solidify, preferably by means of heat or radiation. Solidification results from removal of the liquid from the mixture. In the case of resinous binders, solidification also results from curing of the resin. After the mixture is solidified, it is crushed into the form of agglomerates and graded to the desired size. Devices suitable for this step include conventional jaw crushers and roll crushers.

The crushing and grading procedures necessary to obtain agglomerates as described frequently results in the agglomerates being of an undesirable size range, and they can either be recycled, e.g., by being added to a new dispersion, or discarded. In utilizing the agglomerates to prepare coated abrasive products, coating through a screen can be employed to eliminate excessively large agglomerates.

The agglomerates of this invention can be used to make coated abrasive products, bonded abrasive products, e.g., grinding wheels, nonwoven abrasive products, and other products where abrasive grains are typically employed.

Individual abrasive grains can be used along with the agglomerates of this invention, and the proportion of individual abrasive grains employed in this manner may be as high as 70% of the weight of the agglomerates.

Figure 2:
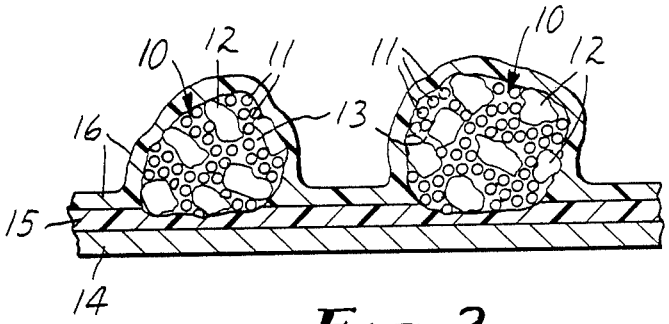
FIG. 2 is a schematic representation in cross-section of a coated abrasive of this invention.

A coated abrasive that may be produced with the agglomerates of this invention is illustrated in FIG. 2. As illustrated in FIG. 2, the coated abrasive comprises a backing 14. Overlying the backing 14 is a make coat 15 in which are embedded the agglomerates 10 of this invention. A size coat 16 has been applied over the make coat 15 and the agglomerates 10.

In the case of coated abrasive products, agglomerates can be applied to a backing to form the coated abrasive. The backing may be any suitable material which is compatible with the components of the agglomerates and maintains its integrity under curing and abrading conditions. It is also preferable that the backing be in the form of a conformable, flexible sheet. Backings suitable for the present invention are well-known in the art and include vulcanized fiber, polymer, paper, woven and non-woven fabric, foils. The coated abrasive can be prepared in the conventional manner, e.g. applying a make coat over the backing, drop coating the agglomerates over the make coat, applying a size coat, and then curing the thus-applied coatings. The make coats and size coats can be made from conventional materials, e.g. phenolic resins, urea-formaldehyde resins, hide glue, and varnish. Examples of make coats and size coats suitable for the coated abrasives of this invention are described in Leitheiser, U.S. Pat. No. 4,314,827, incorporated herein by reference. Care should be taken so that the size coat does not adversely affect erodability of the agglomerates, i.e., the size coat must not flood the surface of the coated abrasive. Alternatively, in many cases, a size coat is not required, particularly when the resinous binder of the agglomerate is a material normally employed for preparing size coats. It is also contemplated that radiation-curable resins can also be used for the make coat, size coat, or both. Examples of radiation-curable resins are described in assignee's copending application, U.S. Ser. No. 763,331, filed on Aug. 7, 1985, incorporated herein by reference for the radiation-curable resins described therein.

Grinding wheels can be prepared in the manner described in Example 47 of U.S. Pat. No. 4,314,827, previously incorporated herein by reference.

The abrasive articles containing the agglomerates of the present invention provide the advantage of longer life resulting from either more efficient use of abrasive grains or higher grain loading or both. The coated abrasive product can continue to cut long after a single layer of abrasive grains would have been rendered useless. Agglomerates can also permit a higher total amout of grain to be applied to a given area of a coated abrasive product for a given size of individual abrasive grains.

The following, non-limiting examples will further illustrate the invention.

EXAMPLE 1

This example demonstrates a method for making the agglomerates of this invention.

Abrasive grains (heat-treated $Al_2O_3$, grade P120, 2000 g), resinous binder (phenol-formaldehyde, 200 g), and hollow glass microspheres ("3M" Glass Bubbles, available from Minnesota Mining and Manufacturing Company, 25 g) were introduced into a blade mixer, and the resulting mixture was stirred for 10 minutes with a blade-mixer. The mixture, which was in the form of a doughy mass, was then removed from the mixer and then broken into small pellets, about ¼-inch in length, so as to be of a size that would easily enter the crusher after cure. The pellets were then cured at a temperature of 200° F. for a period of time of 14 hours. The cured pellets were then crushed and screened to a size capable of passing an 18 mesh screen but not capable of passing a 32 mesh screen.

EXAMPLES 2–5

The method used to prepare the agglomerates of Example 1 was used to prepare the agglomerates of Examples 2–5, the only exception being in the strength of the glass microspheres. The crush strength of the micropheres of the agglomerates of Examples 1 to 5, inclusive, are shown in Table I.

TABLE I

| Example | Strength of microsphere (psi) |
|---|---|
| 1 | 2000 |
| 2 | 4000 |
| 3 | 250 |
| 4 | 10000 |
| 5 | 750 |

The coated abrasives were prepared by first applying a uniformly thick make coat to a 30 mil thick, 7 inch diameter vulcanized fiber disc. The make coat was a calcium carbonate filled phenolic resin (58% $CaCO_3$). Then agglomerates were uniformly drop coated onto the make coated disc. The make coat was pre-cured for one hour at a temperature of 200° F. Then a size coat was uniformly applied over the layer of agglomerates. The size coat was a cryolite filled phenolic resin (50% cryolite). The make coat and size coat were cured for 12 hours at 200° F.

The agglomerates of Example 1 were used to prepare the coated abrasives of Examples 6 and 11; the agglomerates of Example 2 were used to prepare the coated abrasives of Examples 7 and 12; the agglomerates of Example 3 were used to prepare the coated abrasives of Examples 8 and 13; the agglomerates of Example 4 were used to prepare the coated abrasives of Examples 9 and 14; the agglomerates of Example 5 were used to prepare the coated abrasives of Examples 10 and 15.

The weights of make coat, size coat, and agglomerate coat of the coated abrasive of each Example are shown in Table II.

TABLE II

| Example | Make coat (g) | Size coat (g) | Agglomerate coat (g) |
|---|---|---|---|
| Control | | | |
| 6 | 6.1 | 7.6 | 13.2 |
| 7 | 5.1 | 5.5 | 13.2 |

TABLE II-continued

| Example | Make coat (g) | Size coat (g) | Agglomerate coat (g) |
|---|---|---|---|
| 8 | 4.2 | 6.8 | 14.5 |
| 9 | 5.0 | 6.1 | 14.3 |
| 10 | 5.2 | 6.0 | 13.7 |
| 11 | 5.5 | 5.8 | 13.5 |
| 12 | 5.1 | 5.7 | 12.7 |
| 13 | 5.7 | 6.0 | 14.4 |
| 14 | 4.8 | 5.7 | 13.0 |
| 15 | 5.6 | 5.9 | 12.9 |

The coated abrasives prepared in Examples 1 through 5, inclusive, were tested to determine the total cut expected with a given workpiece. The results of these tests are shown in Tables III and IV. In Table III, the workpiece was 1018 mild steel. In Table IV, the workpiece was 304 stainless steel.

TABLE III

| Example | Initial cut (g/pass) | Total cut | % of control | Test length[2] (min) |
|---|---|---|---|---|
| Control[1] | 17.00 | 31.00 | 100% | 3.00 |
| 6 | 14.00 | 193.00 | 623% | 16.00 |
| 7 | 17.00 | 132.00 | 426% | 12.00 |
| 8 | 19.00 | 92.00 | 297% | 10.00 |
| 9 | 19.00 | 96.00 | 310% | 9.00 |
| 10 | 20.00 | 90.00 | 290% | 10.00 |

[1]Control was 3M-ITE coated abrasive. The abrasive grain was $Al_2O_3$, grade P120. The resinous binder was phenolic resin.
[2]The test was terminated when the rate of cut was 6.00 g/pass or lower.

TABLE IV

| Example | Initial cut (g/pass) | Total cut | % of control | Test length[2] (min) |
|---|---|---|---|---|
| Control[1] | 7.00 | 16.00 | 100% | 3.00 |
| 11 | 11.00 | 30.00 | 188% | 5.00 |
| 12 | 11.00 | 33.00 | 206% | 5.00 |
| 13 | 12.00 | 31.00 | 194% | 5.00 |
| 14 | 11.00 | 30.00 | 188% | 5.00 |
| 15 | 9.00 | 25.00 | 156% | 4.00 |

[1]Control was 3M-ITE coated abrasive. The abrasive grain was $Al_2O_3$, grade P120. The resinous binder was phenolic resin.
[2]The test was terminated when the rate of cut was 5.00 g/pass or lower.

From the data in the foregoing Tables III and IV, it can be seen that all of the coated abrasives of the present invention are superior to the control with respect to total cut.

EXAMPLE 6

This example compares the coated abrasive of the present invention with a conventional fiber disc.

The disc was prepared according to the procedure set forth in Example 1, with the following differences:
Weight of make coat: 8 g
Weight of size coat: 6 g
Weight of agglomerate coat: 13.2 g The agglomerates comprised, by weight, 6% resinous binder (phenol-formaldehyde), 6% cryolite, 1% hollow glass microspheres ("3M" Glass Bubbles, 500 psi crush strength), and 87% heat-treated $Al_2O_3$, grade 80.

Both the disc of this invention and the conventional disc ("Norzon", available from Norton Company) were tested with a 1018 mild steel workpiece. The grade of the individual abrasive grains of the conventional disc was 80.

Figure 3:
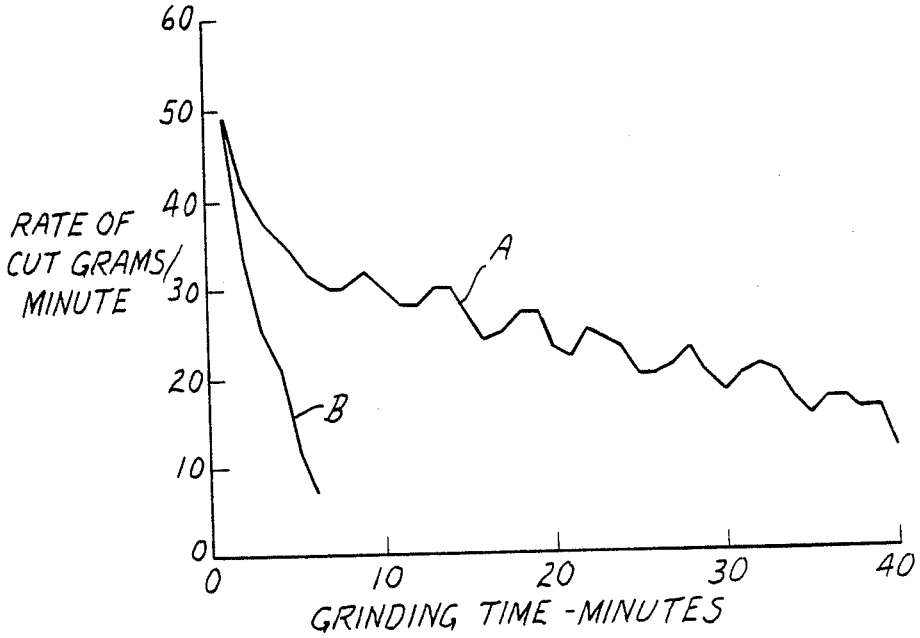
FIG. 3 is a graph comparing the rate of cut as a function of time of a coated abrasive of the present invention with the rate of cut as a function of time of a coated abrasive of the prior art.

The results are shown graphically in FIG. 3. From the graphs in FIG. 3, it can be seen that the fiber disc of the present invention, designated by line A, is superior to the conventional fiber disc, designated by line B, with respect to both length of grinding time before unusable and rate of cut during period of useful life.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An abrasive article comprising erodable agglomerates comprising a multiplicity of individual grains of abrasive mineral randomly distributed in an erodable matrix comprising very small, erodable, crush resistant hollow bodies and an erodable binder.

2. The article of claim 1 wherein said agglomerate contains from about 60 to about 95 weight percent individual abrasive grains, from about 0.3 to about 8 weight percent hollow bodies, and from about 5 to about 30 weight percent binder.

3. The article of claim 1 wherein said binder is a resinous binder.

4. The article of claim 1 wherein said binder is selected from the group consisting of phenolic resins, urea-formaldehyde resins, phenol formaldehyde resins, epoxy resins, and alkyd resins.

5. The article of claim 1 wherein said hollow bodies are made of glass.

6. The article of claim 1 wherein said hollow bodies are spherical in shape and have diameters ranging from about 5 micrometers to about 150 micrometers.

7. The article of claim 1 wherein said hollow bodies have a crush strength ranging from about 100 to about 15,000 psi.

8. Erodable agglomerate suitable for an abrasive product comprising a multiplicity of individual grains of abrasive mineral disposed in an erodable matrix comprising hollow bodies and a binder.

9. The agglomerate of claim 8 wherein said agglomerate contains from about 60 to about 95 weight percent individual abrasive grains, from about 0.3 to about 8 weight percent hollow bodies, and from about 5 to about 30 weight percent binder.

10. The agglomerate of claim 8 wherein said binder is a resinous binder.

11. The agglomerate of claim 10 wherein said binder is selected from the group consisting of phenolic resins, urea-formaldehyde resins, phenol formaldehyde resins, epoxy resins, and alkyd resins.

12. The agglomerate of claim 8 wherein said hollow bodies are made of glass.

13. The agglomerate of claim 8 wherein said hollow bodies are spherical in shape and have diameters ranging from about 5 micrometers to about 150 micrometers.

14. The agglomerate of claim 8 wherein said hollow bodies have a crush strength ranging from about 100 psi to about 15,000 psi.

15. A coated abrasive article comprising the agglomerates of claim 8 secured to a backing.

16. The coated abrasive article of claim 15 wherein said agglomerates are secured to said backing by make and size coats.

17. A bonded abrasive article comprising the agglomerates of claim 8.

18. Method for preparing the agglomerate of claim 8 comprising the steps of:

(a) preparing a mixture comprising grains of an abrasive mineral, binder, and hollow bodies,
(b) causing said mixture to solidify, and
(c) treating said solidified mixture to form agglomerates.

19. The method of claim 18 wherein said binder is a resinous binder.

20. The method of claim 19 wherein said binder is selected from the group consisting of phenolic resins, urea-formaldehyde resins, phenol formaldehyde resins, epoxy resins, and alkyd resins.

21. The method of claim 18 wherein said solidifed mixture is treated by crushing to form agglomerates of the desired size.

22. The method of claim 18 wherein said mixture of step (b) is solidified by heat.

* * * * *